US008142010B2

(12) United States Patent
Ageishi

(10) Patent No.: US 8,142,010 B2
(45) **Date of Patent: *Mar. 27, 2012**

(54) TRANSPORTING BELT FOR INKJET AND INKJET-RECORDING APPARATUS

(75) Inventor: Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1002 days.

This patent is subject to a terminal disclaimer.

(21) Appl. No.: 11/599,551

(22) Filed: Nov. 14, 2006

(65) Prior Publication Data

US 2007/0268352 A1 Nov. 22, 2007

(30) Foreign Application Priority Data

May 17, 2006 (JP) ..... 2006-137745

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS

| | | | | |
|---|---|---|---|---|
| 3,653,755 | A * | 4/1972 | Serfahs et al. | 399/90 |
| 4,823,942 | A * | 4/1989 | Martin et al. | 198/847 |
| 4,937,105 | A | 6/1990 | Sakai et al. | |
| 5,176,374 | A * | 1/1993 | Yamada | 271/9.11 |
| 5,778,291 | A * | 7/1998 | Okubo et al. | 399/302 |
| 5,832,351 | A * | 11/1998 | Takekoshi et al. | 399/303 |
| 5,896,154 | A * | 4/1999 | Mitani et al. | 347/102 |
| 5,942,301 | A * | 8/1999 | Schlueter et al. | 428/58 |
| 5,978,638 | A * | 11/1999 | Tanaka et al. | 399/302 |
| 6,284,373 | B1 | 9/2001 | Ream et al. | |
| 6,652,938 | B1 * | 11/2003 | Nishikawa et al. | 428/35.9 |
| 6,889,029 | B2 * | 5/2005 | Yamanaka et al. | 399/301 |
| 6,935,733 | B2 * | 8/2005 | Fukuda et al. | 347/101 |
| 7,050,731 | B2 | 5/2006 | Bannai et al. | |
| 7,204,584 | B2 * | 4/2007 | Lean et al. | 347/55 |
| 7,280,792 | B2 * | 10/2007 | Sawai et al. | 399/303 |
| 7,448,745 | B2 * | 11/2008 | Kibayashi | 347/104 |
| 7,682,016 | B2 * | 3/2010 | Sakuma et al. | 347/104 |
| 2001/0044025 | A1 * | 11/2001 | Ream et al. | 428/379 |
| 2002/0110381 | A1 * | 8/2002 | Maebashi et al. | 399/49 |
| 2003/0143362 | A1 * | 7/2003 | Hsieh et al. | 428/58 |
| 2004/0183883 | A1 * | 9/2004 | Suzuki et al. | 347/118 |
| 2005/0185988 | A1 * | 8/2005 | Mochimaru | 399/165 |

(Continued)

FOREIGN PATENT DOCUMENTS

JP 01-185688 7/1989

(Continued)

OTHER PUBLICATIONS

Machine Translation of Japanese Application No. 2006-093900; dated Apr. 6, 2006.

(Continued)

*Primary Examiner* — Stephen Meier
*Assistant Examiner* — Leonard S Liang
(74) *Attorney, Agent, or Firm* — Fildes & Outland, P.C.

(57) ABSTRACT

The invention provides a transporting belt for inkjet use, the belt having a seamless belt shape having at least one layer, the innermost layer comprising at least one of polyamide, polyester, and polyimide resins as the resin component and a conductive filler, and having a volume resistivity of about $10^{10}$ to $10^{14}\Omega\cdot$cm.

14 Claims, 3 Drawing Sheets

U.S. PATENT DOCUMENTS

| | | | | |
|---|---|---|---|---|
| 2005/0200689 | A1* | 9/2005 | Shinohara et al. | 347/116 |
| 2006/0045580 | A1* | 3/2006 | Matsuura | 399/316 |
| 2006/0050124 | A1* | 3/2006 | Adachi | 347/104 |
| 2006/0051140 | A1* | 3/2006 | Shimomura et al. | 399/303 |
| 2006/0164491 | A1* | 7/2006 | Sakuma et al. | 347/104 |
| 2006/0284951 | A1* | 12/2006 | Ikeda et al. | 347/103 |
| 2006/0286315 | A1* | 12/2006 | Hashimoto et al. | 428/32.34 |

FOREIGN PATENT DOCUMENTS

| | | | | |
|---|---|---|---|---|
| JP | 11024429 | A | * | 1/1999 |
| JP | 2000143028 | A | * | 5/2000 |
| JP | 2001034076 | A | * | 2/2001 |
| JP | 2001-301083 | | | 10/2001 |
| JP | 2002-012681 | | | 1/2002 |
| JP | 2003-103857 | | | 4/2003 |
| JP | 2003-146470 | | | 5/2003 |
| JP | 2004045916 | A | * | 2/2004 |
| JP | 2005015227 | A | * | 1/2005 |
| JP | 2005-053663 | | | 3/2005 |
| JP | 2006-056612 | | | 3/2006 |
| JP | 2006-093900 | | | 4/2006 |
| JP | 2006-103022 | | | 4/2006 |

OTHER PUBLICATIONS

Machine Translation of Japanese Application No. 2006-056612; dated Mar. 2, 2006.

Japanese Office Action dated Nov. 1, 2011 in Japanese Patent Application No. 2006-137745; and English translation.

* cited by examiner

TRANSPORTING BELT FOR INKJET AND INKJET-RECORDING APPARATUS

BACKGROUND

1. Technical Field

The invention relates to a transporting belt for inkjet and an inkjet-recording apparatus.

2. Related Art

Traditionally in inkjet-recording apparatuses, ink solution is ejected while the inkjet head is scanning in the main scanning direction, and, after one line of scanning of the inkjet head has finished the recording medium is transported in a secondary scanning direction by a specified distance, the inkjet head is scaned again in the main scanning direction, and an image is formed. Since it is necessary to transport the recording medium accurately a specified distance, the recording medium is transported as it is attracted electrostatically onto the surface of the transporting belt by charging the transporting belt. Various transporting belts are known.

Example of the known transporting belt is in a configuration including two layers of ETFE with a volume resistivity preferably set to $10^{15}$ (Ωcm) and performs the electrostatic attraction of the recording medium by stabilizing the charges thereon generated by AC charging. However, such a transporting belt is easily stained by adhesion of the discharging products generated in phenomena of discharge or paper dust and this can lead to a shorter lifetime. In addition, when forming two layers it is difficult to control the film thickness when the resin is melted, and to preserve smoothness of the surface because of the influence of residual strain. Further, it is also not superior in paper attraction and changes of the image quality by the fluctuation of the distance between ink heads caused by floating away from the belt, position and irregularities of the paper used.

SUMMARY

According to an aspect of the invention, there is provided a transporting belt for inkjet use, the belt having a seamless belt shape having at least one layer, the innermost layer including at least one of polyamide, polyester, and polyimide resins as the resin component and a conductive filler and having a volume resistivity of about $10^{10}$ to $10^{14}$Ω·cm.

BRIEF DESCRIPTION OF THE DRAWINGS

Exemplary embodiments of the present invention will be described in detail based on the following FIGS, wherein.

DETAILED DESCRIPTION

Figure 1:
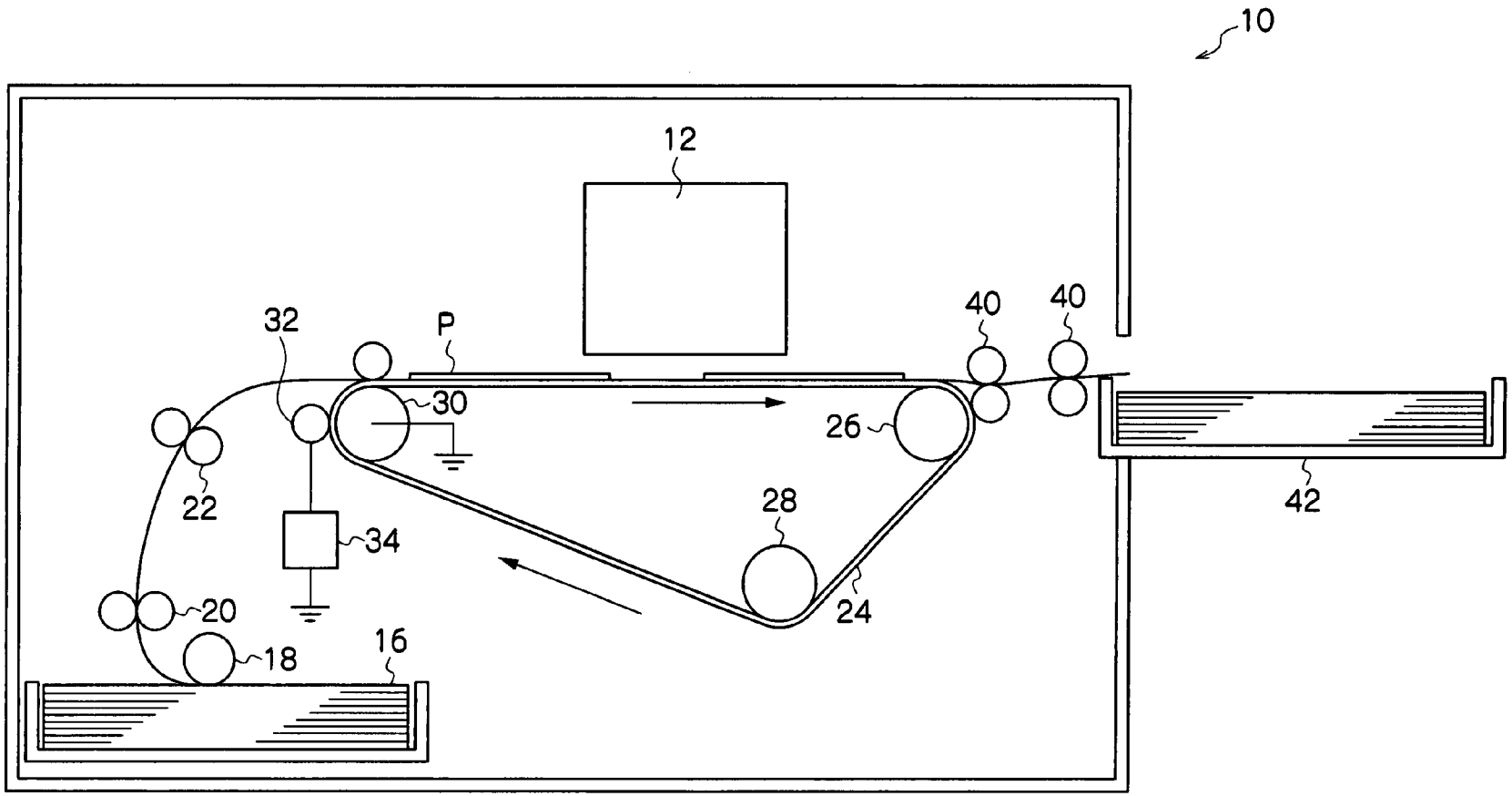
FIG. 1 is a schematic view illustrating the configuration of an inkjet-recording apparatus.

The transporting belt for inkjet according to the invention is a seamless belt-shaped transporting belt for inkjet having at least one layer, wherein the innermost layer (also referred to as base material) contains at least one of polyamide, polyester, and polyimide resins as its resin component and a conductive filler and has a volume resistivity of about $10^{10}$ to $10^{14}$Ω·cm.

The configuration of the seamless belt-shaped transporting belt having at least one layer and containing the above resin component makes it possible to eliminate solvent removal during film preparation and residual strain caused during processing by crosslinking at the point of imidation, and to reduce dimensional fluctuations, waviness and warping, as well as the change in peripheral length associated with environmental changes. Use of the above-mentioned resins also make it possible to improve paper-holding efficiency with reduced fluctuations in film thickness (<1%), to make the transporting belt compatible with color registration, and to reduce the influence of residual charge caused by repeated belt charging, and thus, paves the way for a transporting belt without charge removal.

In addition, a conveyer belt containing a conductive filler and having a volume resistivity of $10^{10}$ to $10^{14}$Ω·cm make it possible to prevent residual charge from accumulation by continuous use during charging and are thus compatible with a stable attraction ability and detachability of the paper. The surface resistivity is preferably about $10^{11}$ to $10^{14}$Ω/cm$^2$ from the viewpoints of the paper attraction ability, transporting and releasing efficiency and the discharging efficiency of the belt. When the surface resistivity is $10^{10}$ or less, discharging efficiency is fast and paper attraction ability decreases for paper with a high proportion of printed area. A surface resistivity of about $10^{11}$ to $10^{14}$Ω/cm$^2$ enables the application of paper attraction ability, transporting and releasing efficiency by generation of desirable surface charges by belt charging.

The surface smoothness, as expressed by gloss (incident angle: 75 degrees), is preferably about 75 or more, more preferably about 80 to 130. The thickness is preferably about 30 to 1,000 μm, more preferably about 50 to 130 μm. When the surface smoothness is 75 or more and a thickness is from 30 to 1000 μm, it may reduce the deposition of ink, paper dust, foreign matter, and others, such that the cleaning efficiency for the blade and the like may be improved, and changes in color registration and elongation due to the undulations and speed fluctuations when conveying the paper may be suppressed.

The surface smoothness can be determined by measuring Rz (10-point-average roughness) in a surface roughness meter or surface reflectivity in a digital precision glossimeter (incident angle: 20 to 75°).

Any known polyamide, polyester, or polyimide resins, may be used as the resin component.

The polyimide resin film for use in the invention is not particularly limited, as long as it is made from a carboxylic acid and a diamine component, in particular, those prepared by reacting an aromatic tetracarboxylic acid component and an aromatic diamine component in organic solvent are preferably used.

Examples of the aromatic tetracarboxylic acid components include pyromellitic acid, naphthalene-1,4,5,8-tetracarboxylic acid, 2,2',3,3'-biphenyltetracarboxylic acid, naphthalene-2,3,6,7-tetracarboxylic acid, 2,3,5,6-biphenyltetracarboxylic acid, 3,3',4,4'-diphenylether tetracarboxylic acid, 3,3',4,4'-benzophenonetetracarboxylic acid, 3,3',4,4'-diphenyltetracarboxylic acid, 3,3',4,4'-diphenylsulfonetetracarboxylic acid, 3,3',4,4'-azobenzene tetracarboxylic acid, bis(2,3-dicarboxyphenyl)methane, bis(3,4-dicarboxyphenylmethane), bis(3,4-dicarboxyphenylpropane), bis(3,4 dicarboxyphenyl) hexafluoropropane, and the like, and these tetracarboxylic acids may be used as a mixture.

The aromatic diamine component is not particularly limited, and examples thereof include m-phenyldiamine, p-phenyldiamine, 2,4-diaminotoluene, 2,6-diaminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminonaphthalene biphenyl, benzidine, 3,3'-dimethylbenzidine, 3,3'-dimethoxybenzidine, 3,4'-diaminodiphenylether, 4,4'-diaminodiphenylether (ODA), 4,4'-diaminodiphenylsulfide, 3,3'-diaminobenzophenone, 4,4'-diaminophenylsulfone, 4,4'-diaminoazobenzene, 4,4'-diaminodiphenylmethane, bis-aminophenylpropane, and the like.

Examples of the organic solvents include N-methyl-2-pyrrolidone, N,N-dimethylacetamide, dimethylsulfoxide, hexamethylphosphonyltriamide, and the like. As needed, phenols such as cresol, phenol, or xylenol, or hydrocarbons such as hexane, benzene, or toluene may be used in combination. These solvents may be used alone or in combination of two or more.

Examples of the conductive fillers, electron-conductive conductors, include carbon black, graphite, filler of Al, Ni, and copper; tin oxide, zinc oxide, potassium titanate, mixed oxides such as tin oxide-In oxide, or tinoxide-Sb oxide and the like. Examples of the ion-conductive materials include ammonium salts, sulfonate salts, and cationic, nonionic and anionic surfactants. The volume resistivity is controlled to $10^{10}$ to $10^{14}\Omega\cdot$cm, by using these components above arbitrarily. The content of the conductive filler is determined according to the desirable volume resistivity, and is preferably 1 to 50% by mass in the transporting belt for inkjet.

The values of the volume resistance and surface resistance can be determined by using a circular electrode (e.g., "HRS probe" of Hirester IP, manufactured by Mitsubishi Yuka Co., Ltd.) under an environment of 23° C. and 55% RH. An example of the measuring condition is a load of 1.0 kg, a voltage of 100 V, and a charge time of 10 seconds.

The innermost layer is preferably formed by extrusion molding. Foming the innermost layer by extrusion molding is effective in improving uniformity in film thickness, reducing the residual strain during molding, and providing the belt with resistance fluctuation and toughness by orientation in the axial direction. As for the extrusion-molding condition in such a case, the belt is preferably formed into a shape having a uniform film thickness, by crosshead molding in a 90-mm uniaxial extruder at an extruding speed of 1 m/sec.

At least one layer is formed on the innermost layer. The outermost layer of the formed layers preferably contains a fluorine resin. Examples of the fluorine resin surface-coating materials include fluorine resins, fluorine-modified urethanes, silicone resins, copolymerized fluorine rubbers, fluorine resin-copolymerized vinylethers, PFA (tetrafluoroethylene-perfluoroalkoxy resin), powder paints or resin tubes such as of FEP (tetrafluoroethylene-propylene hexafluoride copolymer paint), PTFE (tetrafluoroethylene) paints, PTFE-dispersed urethane paints, enamel, ETFE (polytetrafluoroethylene) tubes, PVdF (polyvinylidene fluoride), PHV (polytetrafluorovinylidene) resin materials, and the like. The transporting belt for inkjet according to the invention preferably has a bilayer structure.

According to the heat resistance of the resin material used for the innermost layer base material, the transporting belt is surface-coated with the surface-coating material above (e.g., by spraying, dipping, flow coating, electrostatic coating, rotational molding) and burned and processed as needed for providing the surface with releasing property. In this way, it is possible to prepare the seamless belt-shaped transporting belt for inkjet according to the invention having at least one layer.

In particular, the transporting belt for inkjet use may be subjected to treatment to form a release coat or release film having a thickness of about 1 to 100 μm thereon. Such a treatment leads to a reduction of ink deposition by improving ink wettability, and decreasing affinity, to the internal surface and also, to a reduction of surface gloss and roughness due to exposure of the surface filler. A film thickness of 1 within 1 μm may lead to a decrease in the leveling effect by surface coating, because of the surface irregularities reflecting those of the base material surface, while a thickness of more than 100 μm may lead to loss of the flexibility of base material layer, deformation, surface deformations, and changes of rigidity, and consequently to fluctuations in belt traveling speed. Additionally, a release coating seems to be effective in decreasing adhesion of paper dust during paper detachment and staining on the paper during double-faced printing, and also in improving cleaning efficiency and image quality by giving a reduction of the coefficient of friction and giving surface smoothness. Fluorine paints generally used include particle dispersions, for example of PTFE, copolymer type paints such as of a FEVE: fluoroethylene-vinylether copolymer, such as Lumifron, and solvent-type paints a PVDF polymer, a soft fluorine resin, and a fluoroepoxy resin. If the base material is heat resistant, a release coating or tubing treatment by using a melting type resin such as PFA may be performed.

A specific example thereof is a transporting belt in a bilayer structure having two layers of film-shaped release layers that is prepared by activating the belt base surface by Na-etching treatment followed by bonding a fluorine tube interface thereon.

Inkjet-Recording Apparatus

As shown in FIG. 1, the inkjet-recording apparatus according to the invention 10 has an inkjet head unit 12 ejecting ink droplets onto a recording medium, recording paper P, and the inkjet head unit 12 has inkjet heads (not shown) ejecting ink droplets in four colors, cyan (C), magenta (M), yellow (Y), and black (K), from nozzles onto the recording paper P. The inkjet heads eject ink droplets all together onto printing regions in the width direction of the recording paper P from a long head having an effective printing region larger than the width of the recording paper P. Any one of known methods may be used for ejecting the ink droplets from the nozzles of the inkjet heads, for example the piezoelectric mode of pressurizing an ink chamber with an piezoelectric element or the thermal mode.

The ink is supplied from an ink tank place above the inkjet head unit 12 (not shown) through a pipe to the inkjet head, and any one of known inks, including aqueous inks, oily inks, and solvent-based inks, may be used.

A removable paper-feeding tray 16 is place in the bottom of inkjet-recording apparatus 10; recording papers P are stored in the paper-feeding tray 16; and a pickup roll 18 is in contact with the recording paper P on top. The recording paper P is fed one by one by the pickup roll 18 from the paper-feeding tray 16 to the position downstream in the transporting direction, and further to the region under the inkjet head unit 12 by transporting rolls 20 and 22 placed along the transporting route.

An endless transporting belt 24, the transporting belt for inkjet according to the invention, is placed below the inkjet head unit 12, and the transporting belt 24 is stretched by a drive roll 26 and coupled driving rolls 28 and 30 in the recording medium-transporting apparatus. The coupled driving roll 30 is grounded.

A charging roll 32 connected to a power supply unit 34 is placed upstream of the position where the recording paper P becomes in contact with the transporting belt 24. The charging roll 32 moves, while holding the transporting belt 24 with the coupled driving roll 30, and is movable between the pressurization position where it presses the transporting belt 24 and the remote position where it is separated from transporting belt 24. The charging roll 32, which has a particular potential difference generated with respect to the coupled driving roll 30 grounded, may discharges the transporting belt 24 at the pressurization position. In the description above, the position of the charging roll 32 placed upstream to the position where the recording paper P becomes in contact with the transporting belt 24, but not limited thereto, and may be placed at any position where it is protected from the stains in the apparatus such as paper dust and ink mist. The power supply unit 34 has a waveform generator generating any known voltage waveform and an amplifier.

In addition, plural discharge roll pairs 40 are placed downstream to the inkjet head unit 12, forming an outlet passage of the recording paper P, and a paper output tray 42 is placed outside the outlet passage of the discharge roll pairs 40.

Figure 2:
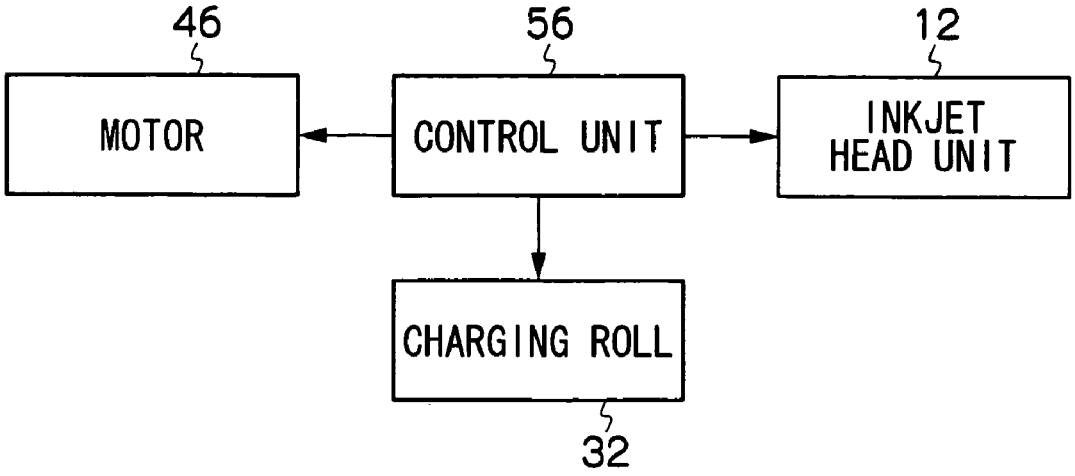
FIG. 2 is a block diagram showing an example of the control system of the inkjet-recording apparatus.

As shown in FIG. 2, each unit of the inkjet-recording apparatus 10 is controlled by a control unit 56 consisting of CPU, ROM, and RAM, and the control unit 56 controls the entire inkjet-recording apparatus 10 including the inkjet head unit 12, charging roll 32, and multiple motors 46 controlling various rolls.

Hereinafter, printing operation in the inkjet-recording apparatus 10 will be described. On receiving a print job instruction, the control unit 56 first makes the system feed a recording paper P from the paper-feeding tray 16, by driving the pickup roll 18, all transporting rolls, and the transporting belt 24. Then, it initializes the nozzle performance of the inkjet head unit 12 by performing a dummy jet; and a head control unit (not shown) controlling ink droplet ejection from the inkjet head unit 12 applies drive voltage to the piezoelectric device of the nozzle corresponding to the image signal at a timing suitable for the image signal.

The recording paper P traveling on the transporting belt 24 is printed in this way. The printing step will be described below in detail. The recording paper P after printing is then fed into the paper output tray 42 by the transporting belt 24 and discharge roll pairs 40.

Figure 3:
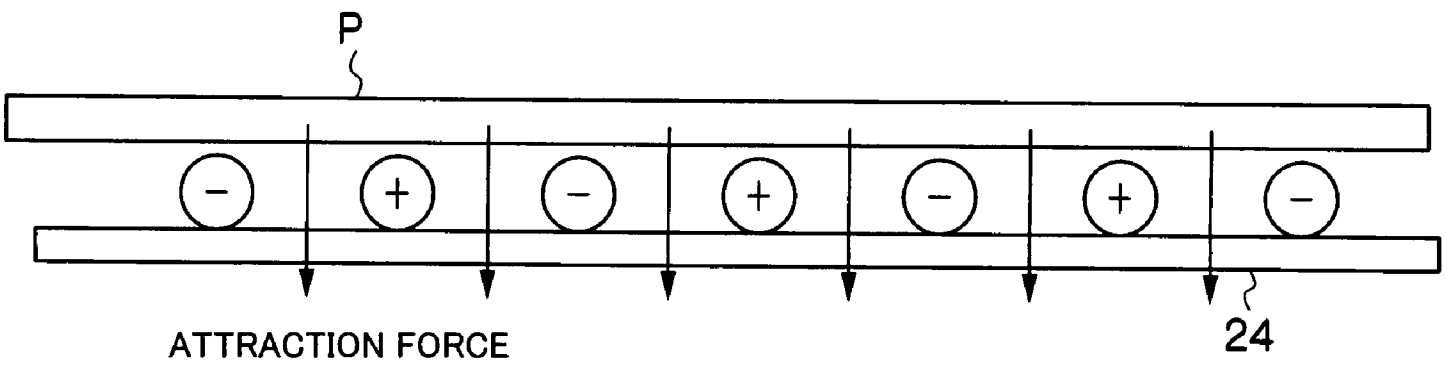
FIG. 3 is an exemplified schematic view of the charges charged on a transporting belt in an embodiment of the invention.

The printing process will be described below. Upon receiving a print job, the control unit 56 first turns on the charging roll 32 and applies the voltage changing in the superimposed waveform described above from the power supply unit 34 to the charging roll 32. When the charging roll 32 discharges to the transporting belt 24, in the region charged on the surface of the transporting belt 24, by the voltage changing in a superimposed high-frequency voltage waveform a charging pattern where the residual charge is evened out and at the same time a pattern corresponding to the frequency of the low-frequency voltage waveform only is formed. Thus, the surface of the transporting belt 24 is charged with positive charges and negative charges alternately as shown in FIG. 3. The recording paper P is attracted electrostatically to the surface of the transporting belt 24 firmly by the force caused by the uneven electric field formed by the positive and negative charge (Maxwell stress). Because the positive charges and the negative charges are deposited alternately, the influence of the electric field from the surface of transporting belt 24 on ejection of ink droplets by the inkjet head unit 12 becomes smaller, and, because the recording paper P is not charged directly, the influence on the attraction force from the properties of the recording paper P (electrical resistivity, thickness, and the like) are small.

Thus, the recording paper P fed onto the transporting belt 24 is attracted onto the transporting belt 24 electrostatically and passes through the printing region of the inkjet head unit 12. At this time, the control unit 56 allows printing on the recoding paper P by driving the inkjet head unit 12. The recording paper P is fed by the discharge roll pairs 40 into the paper output tray 42. The region of the transporting belt 24 where the recording paper P is attracted moves by rotation back to the pressing region of the charging roll 32 by the drive roll 26 and the coupled driving rolls 28 and 30; the remaining charge on the transporting belt 24 is evened out by the changing voltage of the superimposed waveform applied to the charging roll 32; and, once again, positive charges and negative charges corresponding to the frequency of the low-frequency voltage waveform are generated alternately on the transporting belt 24, assuring a stable attraction force.

EXAMPLES

Hereinafter, the invention will be described specifically with reference to Examples, but it should be understood that the invention is not limited thereto. The "part" in the following Examples means part by mass.

Example 1

10 parts of conductive carbon black acetylene black (manufactured by Denki Kagaku Kogyo) are blended with 100 parts of flame-resistant polyamide (9 nylon G2330, manufactured by Kuraray), kneaded, dispersed, and mixed in a two-roll mill at 140° C., and then pulverized into chips in a pulverizer; and the chips are molded into a cylindrical belt having an external diameter of 255 mmϕ by using a biaxial screw extruder (cylinder temperature: 300 to 320° C.).

Separately, a silicone resin is spray-coated as a release material on the peripheral surface of an aluminum cylindrical core body having an external diameter of 250 mm and a length of 500 mm to a thickness of 1 μm and baked at 380° C. for 1 hour.

The extrusion-molded belt prepared is placed around the cylindrical core body and annealing-treated at 150° C. for 1 hour; the resin belt is separated from the core body and cut to pieces having a width of 365 mm, to give a transporting belt for inkjet having a film thickness of 122 μm, a volume resistivity of $10^{11.3}$ Ωcm, and an electric resistivity of $10^{12.4}$ Ω/cm$^2$.

The volume resistivity is the average of that of the belt determined at nine points each in the peripheral and axial directions under an environment of 23° C. and 55% RH by using a cylindrical electrode HR probe of Hirester IP manufactured by Mitsubishi Yuka under load condition of 1 kg, and a voltage of 100 V (charging for 10 seconds). The surface resistivity is the average of those determined, similarly to the volume resistivity above, by measuring the resistivity of the coupled driving electrode between the external and internal electrode with an HR probe under the same conditions. The gloss (incident angle: 75°), as determined by using a precision glossimeter manufactured by Murakami Color Research, is 83.

An image is formed while the transporting belt for inkjet is placed in an inkjet image-forming apparatus, and the quality of the image is evaluated. In addition, paper attraction property when a DC voltage (3 kV) is applied to the surface of the transporting belt for inkjet is observed, and releasing efficiency after printing is evaluated. Results are summarized in the following Table 1. As apparent from Table 1, it is possible to obtain favorable paper attraction property and favorable images. In Table 1, "V-0", an indicator of flame resistance of self-extinguishing plastics, is determined from the flammability when a sample is burned with a burner as specified in UL94 Standard; continuing from V-0 and V-1, "V-2" indicates a lower flame resistance; and the specific methods of determining them are described in JIS C-6481, Fed. No. 406 (method 2021).

Example 2

A urethane-fluorine copolymer FF209 manufactured by Dainichiseika Color & Chemicals Mfg. Co., Ltd. (in MEK solution) is spray-coated on the peripheral surface of the transporting belt for inkjet of Example 1, forming a surface release layer having a thickness of 5 μm, to give a two-layered transporting belt for inkjet, and the belt is evaluated similarly to Example 1. In addition, the belt is placed in an inkjet image-forming apparatus in a similar manner to Example 1, except that the transporting belt for inkjet is used; and an image is formed, and the image quality is evaluated.

Results are shown in the following Table 1. There is no influence on resistance; the ink deposition is lowered; and favorable paper absorbency is obtained similarly. The gloss of the transporting belt for inkjet in Example 2 is 113.

Example 3

The transporting belt for inkjet of Example 1 is annealed at 160° C. for 1 hour, and then, subjected to Na etching treatment. An ETFE film "Afrex 25N" manufactured by Asahi Glass Co., Ltd. is laminated on the external peripheral surface of the belt, to give a two-layered transporting belt for inkjet.

The belt is evaluated similarly to Example 1. In addition, the belt is placed in an inkjet image-forming apparatus in a similar manner to Example 1, except that the transporting belt for inkjet is used; and an image is formed, and the image quality is evaluated.

Results are summarized in the following Table 1. The resistivity increases, and there is no problem in paper absorbency. The gloss of the transporting belt for inkjet in Example 3 is 106.

Comparative Example 1

A polyimide film transporting belt for inkjet having a film thickness of 105 μm, a volume resistivity of $10^{13.2}$ Ωcm, and a surface resistance of $10^{14.5}$ Ω/cm$^2$ is prepared by performing the forming film treatments similar to Example 1 by using a thermoplastic polyimide resin (Aurum PL450, manufactured by Ube Industries. Ltd.).

In addition, the belt is placed in an inkjet image-forming apparatus in a similar manner to Example 1, except that the transporting belt for inkjet is used; and an image is formed, and the image quality is evaluated. Results are summarized in the following Table 1. There is no problem in paper absorbency, but the surface resistance is higher, and there is a problem in releasing efficiency, demanding a static eliminator in the evaluation. The gloss of the transporting belt for inkjet in Comparative Example 1 is 58.

In the Table 1, A represents no problem in the belt absorbency and B represents problematic in the belt absorbency.

TABLE 1

| | | Example 1 | Example 2 | Example 3 | Comparative Example 1 |
|---|---|---|---|---|---|
| Material | Innermost layer | Polyamide | Polyamide | Polyester | Polyimide |
| | Outermost layer | No surface treatment | FF209 | ETFE | — |

TABLE 1-continued

| | | Example 1 | Example 2 | Example 3 | Comparative Example 1 |
|---|---|---|---|---|---|
| Thickness (μm) | Innermost layer | 122 | 113 | 93 | 105 |
| | Outermost layer | — | 5 | 25 | — |
| Flame resistance | | V-0 | V-0 | V-2 | V-0 |
| Volume resistivity (log Ωcm) | | 11.3 | 10.7 | 12.2 | 13.2 |
| Surface resistivity (log Ω/cm$^2$) | | 12.4 | 11.8 | 13.4 | 14.5 |
| Belt absorbency | | A | A | A | B (no static elimination) |

Flame resistance is measured based on UL94 standard.

All publications, patent applications, and Technical standards mentioned in this specification are herein incorporated by reference to the same extent as if each individual publication, patent application, or technical standard was specifically and individually indicated to be incorporated by reference.

What is claimed is:

1. A transporting belt for inkjet use, the belt having a seamless belt shape having more than one layer including an innermost layer comprising at least one of polyamide, polyester, and polyimide resin as a resin component and a conductive filler, and the innermost layer having a volume resistivity of about $10^{10}$ to $10^{14}$Ω·cm and a surface resistivity of about $10^{1}$1 to 10$^{14}$ Ω/square.

2. The transporting belt for inkjet use according to claim 1, wherein the surface smoothness, as expressed by gloss, is about 75 or more (incident angle: 75 degrees) and the thickness is about 30 to 1,000 μm.

3. The transporting belt for inkjet use according to claim 2, wherein the innermost layer is formed by extrusion molding.

4. The transporting belt for inkjet use according to claim 3, wherein the transporting belt is subjected to a release coat treatment or a release film treatment of a thickness of about 1 to 100 μm.

5. The transporting belt for inkjet use according to claim 2, wherein the transporting belt is subjected to a release coat treatment or a release film treatment of a thickness of about 1 to 100 μm.

6. The transporting belt for inkjet use according to claim 1, wherein the innermost layer is formed by extrusion molding.

7. The transporting belt for inkjet use according to claim 6, wherein the transporting belt is subjected to a release coat treatment or a release film treatment of a thickness of about 1 to 100 μm.

8. The transporting belt for inkjet use according to claim 1, wherein the transporting belt is subjected to a release coat treatment or a release film treatment of a thickness of about 1 to 100 μm.

9. The transporting belt for inkjet use according to claim 1, wherein the innermost layer comprises polyester and a surface of the belt is alternately charged with positive charge and negative charge.

10. An inkjet-recording apparatus, comprising: a recording medium-transporting apparatus including a transporting belt for inkjet use, the belt having a seamless belt shape having more than one layer including an innermost layer comprising at least one of polyamide, polyester, and polyimide resin as a resin component and a conductive filler, and the innermost layer of the belt having a volume resistivity of about $10^{10}$ to $10^{14}\Omega\cdot$cm and a surface resistivity of about $10^{11}$ to $10^{14}\Omega$/square; and a recording head ejecting ink droplets onto a recording medium.

11. The inkjet-recording apparatus according to claim 10, wherein the surface smoothness of the transporting belt for inkjet use, as expressed by gloss, is about 75 or more (incident angle: 75 degrees) and the thickness is about 30 to 1,000 μm.

12. The inkjet-recording apparatus according to claim 10, wherein the innermost layer of the transporting belt for inkjet use is formed by extrusion molding.

13. The inkjet-recording apparatus according to claim 10, wherein the transporting belt for inkjet use is subjected to a release coat treatment or a release film treatment of a thickness of about 1 to 100 μm.

14. The transporting belt for inkjet use according to claim 10, wherein the innermost layer comprises polyester and a surface of the belt is alternately charged with positive charge and negative charge.

* * * * *